US011621136B2

(12) United States Patent
Mori et al.

(10) Patent No.: US 11,621,136 B2
(45) Date of Patent: Apr. 4, 2023

(54) RELAY

(71) Applicant: OMRON Corporation, Kyoto (JP)

(72) Inventors: Shingo Mori, Yamaga (JP); Ryota Minowa, Yamaga (JP); Yasuo Hayashida, Kumamoto (JP); Naoki Kawaguchi, Yame (JP); Kohei Otsuka, Omuta (JP); Hiroyuki Iwasaka, Kumamoto (JP)

(73) Assignee: OMRON CORPORATION, Kyoto (JP)

( * ) Notice: Subject to any disclaimer, the term of this patent is extended or adjusted under 35 U.S.C. 154(b) by 0 days.

(21) Appl. No.: 17/262,214

(22) PCT Filed: Feb. 19, 2019

(86) PCT No.: PCT/JP2019/006169

§ 371 (c)(1),
(2) Date: Jan. 22, 2021

(87) PCT Pub. No.: WO2020/039619

PCT Pub. Date: Feb. 27, 2020

(65) Prior Publication Data

US 2021/0304994 A1 Sep. 30, 2021

(30) Foreign Application Priority Data

Aug. 21, 2018 (JP) ..... JP2018-154579

(51) Int. Cl.
*H01H 3/00* (2006.01)
*H01H 50/54* (2006.01)
(Continued)

(52) U.S. Cl.
CPC ..... *H01H 50/546* (2013.01); *H01H 50/02* (2013.01); *H01H 50/14* (2013.01); *H01H 50/18* (2013.01)

(58) Field of Classification Search
CPC ..... H01H 50/546; H01H 50/02; H01H 50/14; H01H 50/18; H01H 9/30; H01H 9/302; H01H 9/443; H01H 2050/028
(Continued)

(56) References Cited

U.S. PATENT DOCUMENTS 2,571,735 A * 10/1951 Lindell ..... H01H 85/42 337/275
5,892,194 A * 4/1999 Uotome ..... H01H 51/065 335/154
(Continued)

FOREIGN PATENT DOCUMENTS

EP 2442345 A1 * 4/2012 ..... H01H 51/065
JP 2007-214034 A 8/2007
(Continued)

OTHER PUBLICATIONS

The International Search Report of International Application No. PCT/JP2019/006169 dated May 28, 2019.
(Continued)

*Primary Examiner* — Shawki S Ismail
*Assistant Examiner* — Lisa N Homza
(74) *Attorney, Agent, or Firm* — Shinjyu Global IP

(57) ABSTRACT

A relay includes a movable contact piece having a first movable contact and a second movable contact, a first fixed terminal having a first fixed contact, a second fixed terminal having a second fixed contact, a drive device configured to move the movable contact piece, and the wall portion disposed inside the first fixed contact and the second fixed contact in a longitudinal direction. At least a part of the wall portion is disposed at a position beyond the first fixed contact and the second fixed contact toward the movable contact piece in a moving direction of the movable contact piece. The movable contact piece has a shape so as to avoid
(Continued)

the wall portion in a contact state where the first movable contact is in contact with the first fixed contact and the second movable contact is in contact with the second fixed contact.

14 Claims, 12 Drawing Sheets

(51) Int. Cl.
*H01H 50/02* (2006.01)
*H01H 50/14* (2006.01)
*H01H 50/18* (2006.01)

(58) Field of Classification Search
USPC ..... 335/185
See application file for complete search history.

(56) References Cited

U.S. PATENT DOCUMENTS 8,269,585 B2 * 9/2012 Choi ..... H01H 1/2008 335/196
8,816,801 B2 * 8/2014 Tachikawa ..... H01H 50/546 335/131
2006/0109070 A1 * 5/2006 Hirabayashi ..... H01H 51/065 335/126
2007/0241847 A1 * 10/2007 Yamamoto ..... H01H 50/305 335/196
2009/0322455 A1 * 12/2009 Yoshihara ..... H01H 50/36 335/189
2012/0092098 A1 * 4/2012 Choi ..... H01H 51/065 335/189
2013/0214881 A1 8/2013 Ito et al.
2013/0214882 A1 8/2013 Ito et al.
2013/0214884 A1 * 8/2013 Ito ..... H01H 50/546 335/154
2013/0228552 A1 * 9/2013 Kashimura ..... H01H 51/22 218/26
2015/0048908 A1 * 2/2015 Isozaki ..... H01H 1/54 335/6
2015/0054605 A1 * 2/2015 Kubono ..... H01H 9/443 335/177
2016/0181038 A1 * 6/2016 Shimizu ..... H01H 50/42 335/165
2016/0300676 A1 * 10/2016 Sakai ..... H01H 47/22
2018/0223783 A1 * 8/2018 Bohmann ..... F16K 31/0689
2019/0304724 A1 * 10/2019 Minowa ..... H01H 50/42
2019/0304728 A1 * 10/2019 Minowa ..... H01H 49/00

FOREIGN PATENT DOCUMENTS

JP 2008-282719 A 11/2008
WO 2012/060090 A1 5/2012
WO WO-2012157218 A1 * 11/2012 ..... H01H 33/182
WO 2013/051263 A1 4/2013

OTHER PUBLICATIONS

The Written Opinion of the International Searching Authority of International Application No. PCT/JP2019/006169 dated May 28, 2019.

* cited by examiner

RELAY

CROSS-REFERENCE TO RELATED APPLICATION

This application is the U.S. National Phase of International Application No. PCT/JP2019/006169, filed on Feb. 19, 2019. This application claims priority to Japanese Patent Application No. 2018-154579, filed Aug. 21, 2018. The contents of that application are incorporated by reference herein in their entireties.

FIELD

The present invention relates to a relay.

BACKGROUND

Some relays have a structure for extinguishing an arc generated at contacts. For example, in Japanese Laid-Open Patent Application No. 2007-214034, a wall portion is arranged inside a fixed contact portion. The fixed contact portion includes a fixed contact touch portion and a fixed contact pedestal portion to which the fixed contact touch portion is fixed. The height of the wall portion is higher than the height of the fixed contact pedestal portion and lower than the height of the fixed contact touch portion.

In Patent Document 1, the creepage distance of the arc current is increased by the aforementioned wall portion. As a result, the arc current is less likely to be short-circuited. In addition, the height of the wall portion as described above prevents the operation of a movable contact portion from being hindered.

SUMMARY

In Patent Document 1, the wall portion cannot be raised in order to avoid interference with the movable contact portion. Therefore, it is difficult to improve the arc interruption capability by the wall portion.

An object of the present invention is to improve the arc interruption capability while avoiding obstructing the operation of a movable contact piece in a relay.

A relay according to one aspect includes a movable contact piece, a first fixed terminal, a second fixed terminal, a drive device, and a wall portion. The movable contact piece includes a first movable contact and a second movable contact disposed apart from each other in a longitudinal direction of the movable contact piece. The first fixed terminal includes a first fixed contact disposed to face the first movable contact. The second fixed terminal includes a second fixed contact disposed to face the second movable contact. The drive device moves the movable contact piece in a direction in which the first movable contact and the second movable contact come into contact with the first fixed contact and the second fixed contact and in a direction in which the first movable contact and the second movable contact are separated from the first fixed contact and the second fixed contact. The wall portion is disposed inside the first fixed contact and the second fixed contact in the longitudinal direction. At least a part of the wall portion is disposed at a position beyond the first fixed contact and the second fixed contact toward the movable contact piece in a moving direction of the movable contact piece. The movable contact piece has a shape so as to avoid the wall portion in a state where the first movable contact and the second movable contact are in contact with the first fixed contact and the second fixed contact.

In the relay according to this aspect, at least a part of the wall portion is disposed at a position beyond the first fixed contact and the second fixed contact toward the movable contact piece in the moving direction of the movable contact piece. Therefore, when an arc is drawn inward of the first fixed contact and the second fixed contact, it easily hits the wall portion. As a result, the arc can be extinguished quickly. Further, the movable contact piece has a shape so as to avoid the wall portion in a state where the first movable contact and the second movable contact are in contact with the first fixed contact and the second fixed contact. As a result, even if the wall portion is disposed in the above described manner, interference between the movable contact piece and the wall portion can be avoided.

The wall portion may be formed of an arc extinguishing material that generates an arc extinguishing gas by heat of the arc. In this case, the arc can be extinguished more quickly by generating the arc extinguishing gas from the wall portion.

The movable contact piece may have a shape recessed in a direction away from the wall portion. In this case, interference with the wall portion can be avoided for the recessed shape of the movable contact piece.

The movable contact piece may include a curved portion curved in a direction away from the wall portion. In this case, interference with the wall portion can be avoided for the shape of the curved portion of the movable contact piece. Further, the starting point of the arc can be limited to the curved portion.

The curved portion may be disposed to face the wall portion. In this case, the arc drawn from the curved portion hits the wall portion more easily. Thereby, the arc can be extinguished more quickly.

The movable contact piece may include a hole disposed to face the wall portion. In this case, because the wall portion is disposed in the hole in a state where the first movable contact and the second movable contact are in contact with the first fixed contact and the second fixed contact, interference with the wall portion can be avoided.

The movable contact piece may include a recess disposed to face the wall portion. In this case, because the wall portion is disposed in the recess in a state where the first movable contact and the second movable contact are in contact with the first fixed contact and the second fixed contact, interference with the wall portion can be avoided.

The movable contact piece may include a first contact support portion and a second contact support portion. The first contact support portion may support the first movable contact. The second contact support portion may support the second movable contact. In the longitudinal direction of the movable contact piece, an inner end portion of the first contact support portion and an inner end portion of the second contact support portion may be disposed apart from each other. The wall portion may be disposed to face a space between the inner end portion of the first contact support portion and the inner end portion of the second contact support portion. In this case, because the wall portion is disposed between the inner end portion of the first contact support portion and the inner end portion of the second contact support portion in a state where the first movable contact and the second movable contact are in contact with the first fixed contact and the second fixed contact, interference with the wall portion can be avoided.

The wall portion may overlap with the first movable contact and the first fixed contact when viewed from the longitudinal direction of the movable contact piece in a state where the first movable contact and the second movable contact are in contact with the first fixed contact and the second fixed contact. In this case, the arc hits the wall portion more easily. As a result, the arc can be extinguished more quickly.

The first fixed terminal may include a contact support portion and an intermediate portion. The contact support portion may support the first fixed contact and extend outward from the first fixed contact in the longitudinal direction. The intermediate portion may extend from the contact support portion in a direction parallel to the moving direction of the movable contact piece. In this case, due to an electric current flowing through the intermediate portion, the Lorentz force directing inward of the first fixed contact and the second fixed contact is likely to act on the arc. However, even if the arc is drawn inward of the first fixed contact and the second fixed contact, the arc can be extinguished quickly by the wall portion.

DETAILED DESCRIPTION

Figure 1:
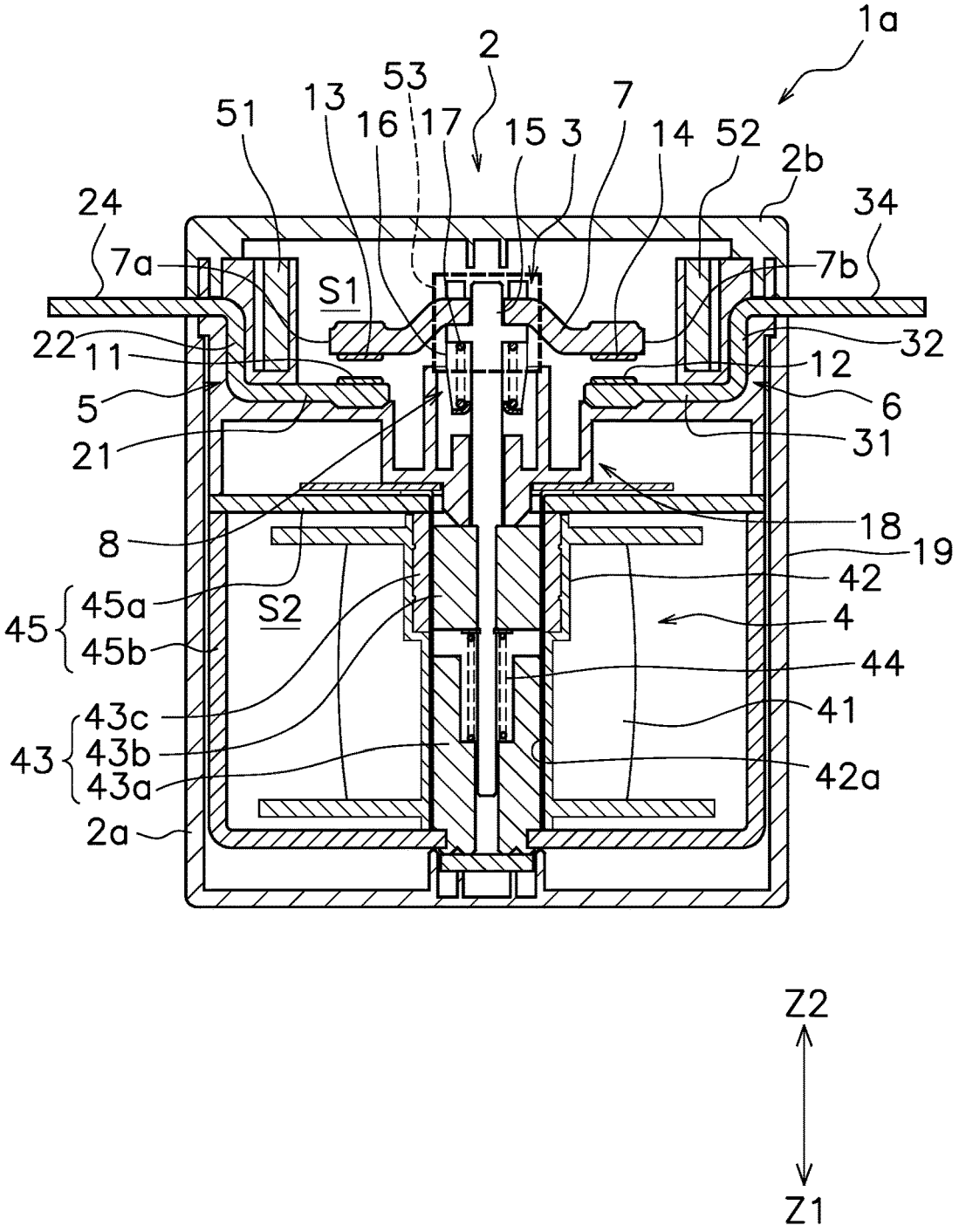
FIG. 1 is a side cross-sectional view illustrating a relay according to a first embodiment.

Hereinafter, a relay according to the embodiments will be described with reference to the drawings. FIG. 1 is a side cross-sectional view showing a relay 1*a* according to a first embodiment. As illustrated in FIG. 1, the relay 1*a* includes a case 2, a contact device 3, and a drive device 4. In the following description, each direction of up(ward), down(ward), left and right means each direction of up(ward), down(ward), left and right in FIG. 1. Further, the front-back direction is assumed to mean a direction perpendicular to the sheet of FIG. 1. However, the definitions of these directions do not limit the arrangement direction of the relay 1*a*.

The case 2 houses the contact device 3 and the drive device 4. The case 2 is made of an insulating resin. The case 2 includes a case body 2*a* and a lid portion 2*b*. The contact device 3 and the drive device 4 are disposed in the case body 2*a*. The lid portion 2*b* is separate from the case body 2*a*. The lid portion 2*b* is attached to the case body 2*a*. The case body 2*a* includes a contact case 18 and an outer case 19. The contact case 18 divides the inside of the case 2 into a first storage portion S1 and a second storage portion S2. The contact device 3 is disposed in the first storage portion S1. The drive device 4 is disposed in the second storage portion S2. The outer case 19 accommodates the contact case 18 inside.

The contact device 3 includes a first fixed terminal 5, a second fixed terminal 6, a movable contact piece 7, and a contact piece holding portion 8. The first fixed terminal 5, the second fixed terminal 6, and the movable contact piece 7 are formed of a conductive material such as copper. The first fixed terminal 5 includes a first fixed contact 11. The second fixed terminal 6 includes a second fixed contact 12. The first fixed contact 11 and the second fixed contact 12 are disposed apart from each other in the left-right direction.

The movable contact piece 7 extends in the left-right direction. In the present embodiment, the longitudinal direction of the movable contact piece 7 coincides with the left-right direction. The movable contact piece 7 includes a first movable contact 13 and a second movable contact 14. The first movable contact 13 and the second movable contact 14 are disposed apart from each other in the left-right direction. The first movable contact 13 is disposed to face the first fixed contact 11. The second movable contact 14 is disposed to face the second fixed contact 12.

The movable contact piece 7 includes a first end portion 7*a* and a second end portion 7*b*. The first end portion 7*a* is one end portion of the movable contact piece 7 in the left-right direction. The second end portion 7*b* is the other end portion of the movable contact piece 7 in the left-right direction. In the present embodiment, the first end portion 7*a* is the left end portion of the movable contact piece 7. The second end portion 7*b* is the right end portion of the movable contact piece 7. The first movable contact 13 is disposed between the center of the movable contact piece 7 in the left-right direction and the first end portion 7*a*. The second movable contact 14 is disposed between the center of the movable contact piece 7 in the left-right direction and the second end portion 7*b*.

The movable contact piece 7 is movably disposed in the up-down direction. Specifically, the movable contact piece 7 is movably disposed in a contact direction Z1 and an separation direction Z2. The contact direction Z1 is the direction in which the first movable contact 13 and the second movable contact 14 come into contact with the first fixed contact 11 and the second fixed contact 12 (downward in FIG. 1). The separation direction Z2 is the direction in which the first movable contact 13 and the second movable contact 14 are separated from the first fixed contact 11 and the second fixed contact 12 (upward in FIG. 1).

The contact piece holding portion 8 holds the movable contact piece 7. The contact piece holding portion 8 holds the movable contact piece 7 at the center thereof in the left-right direction. Therefore, the contact piece holding portion 8 holds the movable contact piece 7 at a position between the first movable contact 13 and the second movable contact 14 in the left-right direction.

The contact piece holding portion 8 includes a drive shaft 15, a holder 16, and a contact spring 17. The drive shaft 15 extends in the up-down direction. The drive shaft 15 connects the movable contact piece 7 and the drive device 4. The drive shaft 15 is movably disposed in the contact direction Z1 and the separation direction Z2. The holder 16 is connected to the movable contact piece 7 and holds the movable contact piece 7. The contact spring 17 is disposed between the drive shaft 15 and the holder 16. The drive shaft 15 is connected to the holder 16 via the contact spring 17.

The first fixed terminal 5 includes a first contact support portion 21, a first intermediate portion 22, and a first external connection portion 24. The first contact support portion 21 supports the first fixed contact 11 in the case 2. The first contact support portion 21 extends outward from the first fixed contact 11 in the left-right direction. Outward in the left-right direction means a direction away from the central axis line of the drive shaft 15 in the left-right direction. Inward in the left-right direction means a direction approaching the central axis line of the drive shaft 15 in the left-right direction.

The first intermediate portion 22 is located between the first contact support portion 21 and the first external connection portion 24. The first intermediate portion 22 extends from the first contact support portion 21 in a direction parallel to the moving direction of the movable contact piece 7, that is, in the up-down direction. Specifically, the first intermediate portion 22 extends upward from the first contact support portion 21. The first external connection portion 24 extends to the left from the first intermediate portion 22. The first external connection portion 24 protrudes outward of the case 2.

The first fixed terminal 5 has a shape that bends between the first contact support portion 21 and the first intermediate portion 22, and between the first intermediate portion 22 and the first external connection portion 24. The first contact support portion 21, the first intermediate portion 22, and the first external connection portion 24 may be integrally formed. Alternatively, the first contact support portion 21, the first intermediate portion 22 and the first external connection portion 24 may be separate and connected to each other by fixing means such as welding.

The second fixed terminal 6 includes a second contact support portion 31, a second intermediate portion 32, and a second external connection portion 34. The second contact support portion 31 supports the second fixed contact 12 in the case 2. The second fixed terminal 6 has a shape bilaterally symmetrical to that of the first fixed terminal 5. The second contact support portion 31, the second intermediate portion 32, and the second external connection portion 34 correspond to the first contact support portion 21, the first intermediate portion 22, and the first external connection portion 24, respectively. Therefore, detailed explanation of the second fixed terminal 6 will be omitted.

The drive device 4 generates a driving force for operating the movable contact piece 7. The drive device 4 operates the movable contact piece 7 by an electromagnetic force. The drive device 4 moves the movable contact piece 7 in the contact direction Z1 and the separation direction Z2. The drive device 4 is disposed below the movable contact piece 7. The drive device 4 includes a coil 41, a spool 42, an iron core 43, a return spring 44, and a yoke 45.

The coil 41 is wound around the spool 42. The coil 41 and the spool 42 are disposed coaxially with the drive shaft 15. The spool 42 includes a hole 42*a* penetrating in the axial direction of the spool 42. The iron core 43 and the return spring 44 are inserted into the hole 42*a* of the spool 42. The yoke 45 is connected to the iron core 43.

The yoke 45 includes a first yoke 45*a* and a second yoke 45*b*. The first yoke 45*a* is disposed between the contact device 3 and the spool 42. The second yoke 45*b* is connected to the first yoke 45*a*. The second yoke 45*b* has a U-shape. The second yoke 45*b* is disposed on both sides of the coil 41 and on the opposite side of the first yoke 45*a* with respect to the coil 41.

The iron core 43 includes a fixed iron core 43*a*, a movable iron core 43*b*, and a ring iron core 43*c*. The fixed iron core 43*a* is fixed to the second yoke 45*b*. The ring iron core 43*c* is in contact with the first yoke 45*a*. The movable iron core 43*b* is separate from the fixed iron core 43*a* and the ring iron core 43*c*. The movable iron core 43*b* is movably disposed in the contact direction Z1 and the separation direction Z2. The movable iron core 43*b* moves within the ring iron core 43*c*. The movable iron core 43*b* is connected to the drive shaft 15. The return spring 44 is disposed between the movable iron core 43*b* and the fixed iron core 43*a*. The return spring 44 urges the movable iron core 43*b* in the separation direction Z2.

Next, the operation of the relay 1*a* will be described. When no electric current is flowing through the coil 41 and the coil 41 is not excited, the drive shaft 15 is pressed in the separation direction Z2 together with the movable iron core 43*b* by the elastic force of the return spring 44. Therefore, the movable contact piece 7 is also pressed in the separation direction Z2, and as illustrated in FIG. 1, the first movable contact 13 and the second movable contact 14 are in an open state in which they are separated from the first fixed contact 11 and the second fixed contact 12.

When an electric current is flowing through the coil 41 and the coil 41 is excited, the movable iron core 43*b* moves in the contact direction Z1 against the elastic force of the return spring 44 due to the electromagnetic force of the coil 41. As a result, the drive shaft 15, the holder 16, and the movable contact piece 7 move in the contact direction Z1 together, whereby the first movable contact 13 and the second movable contact 14 are in a closed state in which they come in contact with the first fixed contact 11 and the second fixed contact 12.

When the electric current to the coil 41 is stopped and the coil 41 is demagnetized, the drive shaft 15 is pressed in the separation direction Z2 together with the movable iron core 43*b* by the elastic force of the return spring 44. Therefore, the movable contact piece 7 is also pressed in the separation direction Z2, so that the first movable contact 13 and the second movable contact 14 return to the open state.

Figure 2:
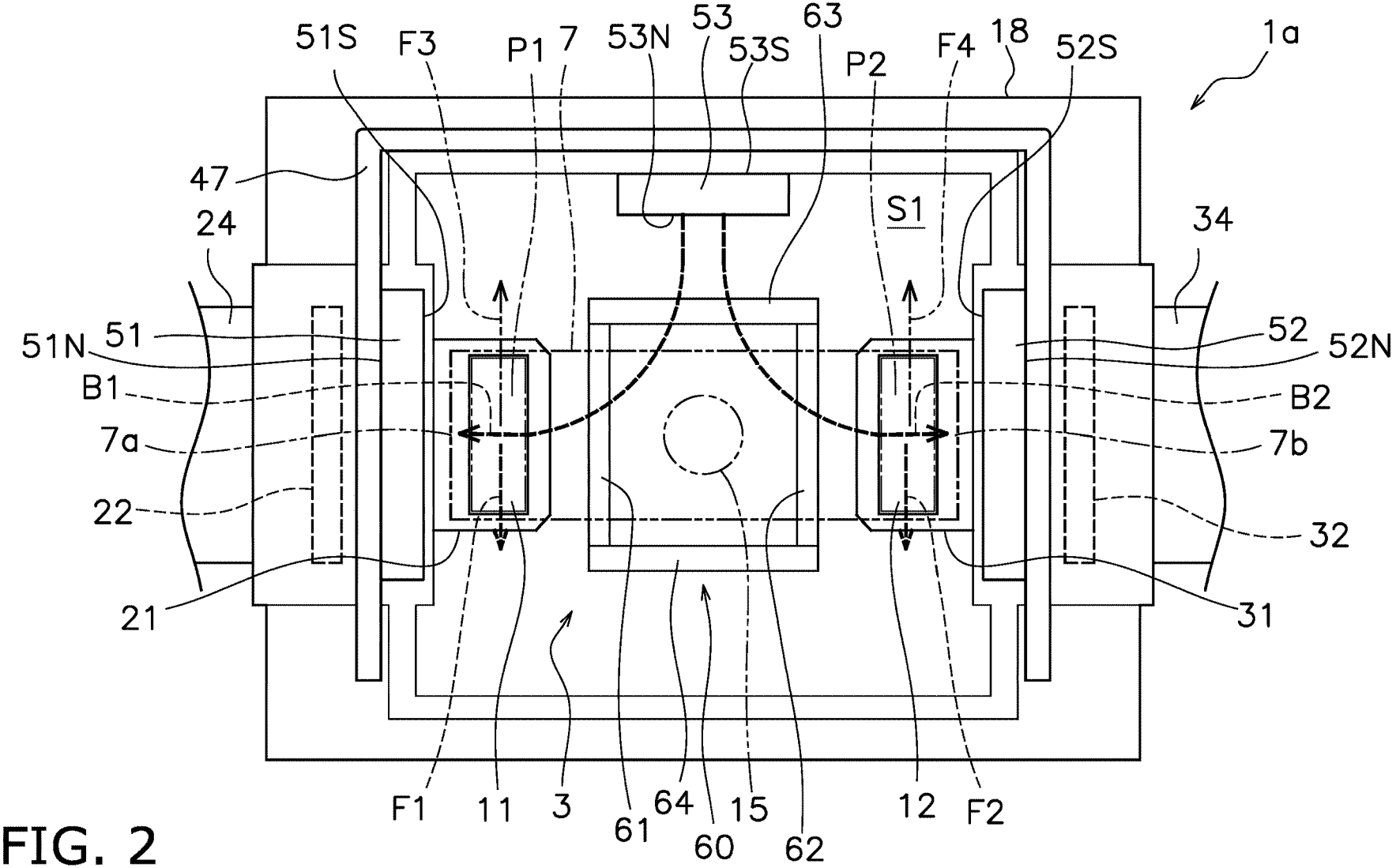
FIG. 2 is a plan view illustrating a configuration inside a contact case of the relay according to the first embodiment.

FIG. 2 is a plan view illustrating a configuration of the relay 1*a* in the contact case 18. In FIG. 2, the positions of the movable contact piece 7 and the drive shaft 15 are indicated by a dashed line. As illustrated in FIG. 1 and FIG. 2, the relay 1*a* includes a first magnet 51, a second magnet 52, and a third magnet 53. The first magnet 51, the second magnet 52, and the third magnet 53 are permanent magnets for extinguishing an arc generated between the contacts.

The first magnet 51 and the second magnet 52 are disposed apart from each other in the left-right direction. The first magnet 51 is disposed on one side of the movable contact piece 7 in the left-right direction. The second magnet 52 is disposed on one side of the movable contact piece 7 in the left-right direction. Specifically, the first magnet 51 is disposed on the left of the movable contact piece 7. The second magnet 52 is disposed on the right of the movable contact piece 7.

The first magnet 51 and the second magnet 52 are disposed so that their same poles face each other. Specifically, the first magnet 51 includes an S pole surface 51S facing the movable contact piece 7 and an N pole surface 51N on the opposite side of the S pole surface 51S. The second magnet 52 includes an S pole surface 52S facing the movable contact piece 7 and an N pole surface 52N on the opposite side of the S pole surface 52S.

The third magnet 53 is disposed to face the movable contact piece 7 in the front-back direction. In the present embodiment, the front-back direction coincides with the width direction of the movable contact piece 7 that intersects the longitudinal direction of the movable contact piece 7. The third magnet 53 includes an N pole surface 53N facing the movable contact piece 7 and an S pole surface 53S on the opposite side of the N pole surface 53N.

Further, the relay 1*a* includes a yoke 47. The yoke 47 connects the first magnet 51, the second magnet 52, and the third magnet 53. Specifically, the yoke 47 is connected to the N pole surface 51N of the first magnet 51, the N pole surface 52N of the second magnet 52, and the S pole surface 53S of the third magnet 53.

Because of the arrangement of the first magnet 51, the second magnet 52, and the third magnet 53 as described above, a magnetic flux B1 directing outward in the left-right direction is generated at a position between the first fixed contact 11 and the first movable contact 13 (hereinafter referred to as a "first contact position P1") as illustrated in FIG. 2. Further, a magnetic flux B2 directing outward in the left-right direction is generated at a position between the second fixed contact 12 and the second movable contact 14 (hereinafter referred to as a "second contact position P2"). Specifically, the magnetic flux B1 directing from the center in the left-right direction to the first end portion 7*a* is generated between the first fixed contact 11 and the first movable contact 13. A magnetic flux B2 directing from the center in the left-right direction to the second end portion 7*b* is generated between the second fixed contact 12 and the second movable contact 14.

Therefore, when an electric current flows from left to right in the movable contact piece 7, the Lorentz force acts in the front-back direction as illustrated by an arrow F1 and an arrow F2 in FIG. 2. Further, when an electric current flows from right to left in the movable contact piece 7, the Lorentz force acts in the front-back direction as illustrated by an arrow F3 and an arrow F4 in FIG. 2. As a result, the arc is drawn in the directions indicated by the arrows F1-F4, and the arc can be extinguished quickly.

Figure 3:
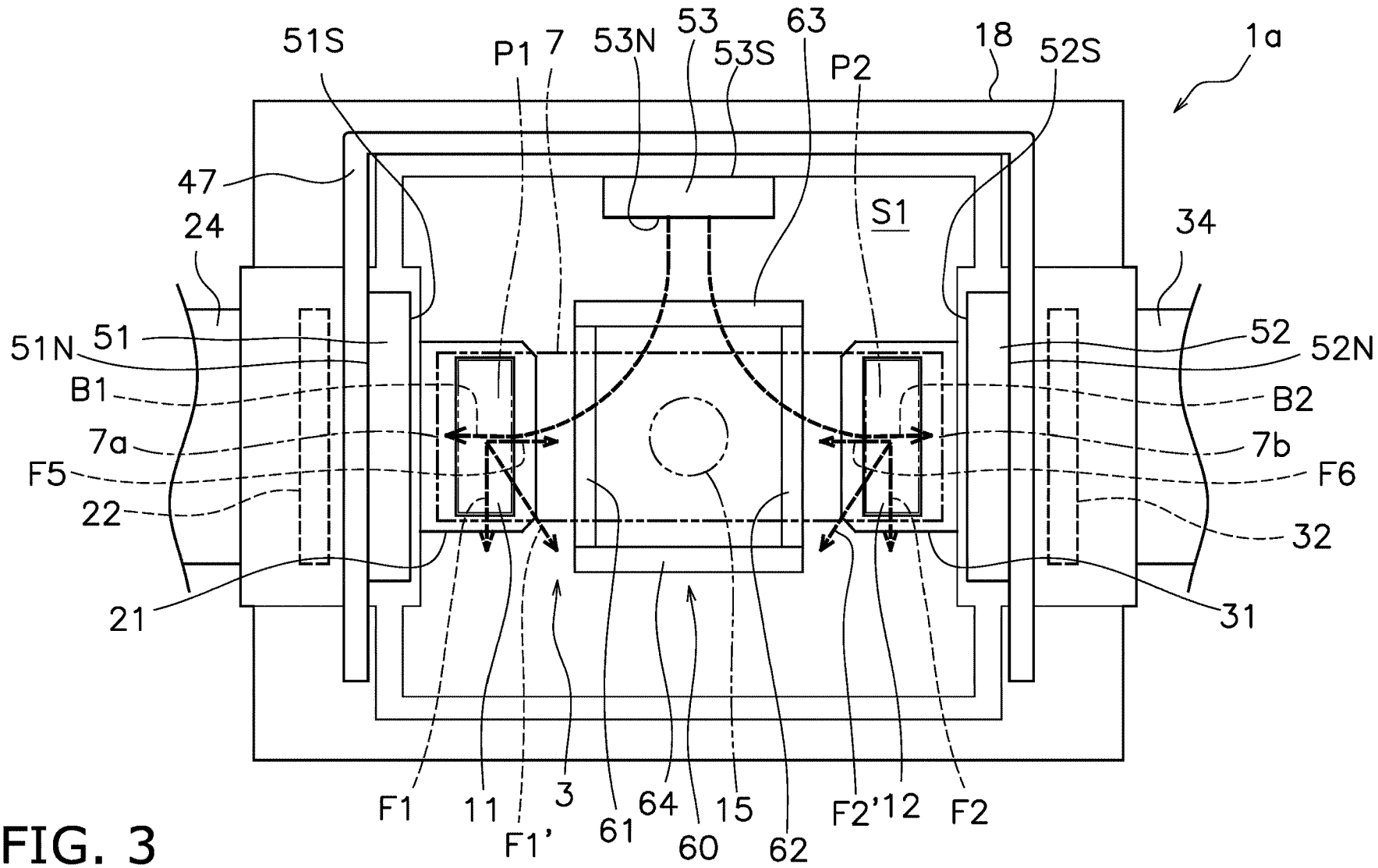
FIG. 3 is a plan view illustrating a configuration inside the contact case of the relay according to the first embodiment.

However, as illustrated in FIG. 3, the Lorentz force due to the self-magnetic field of the first fixed terminal 5 and the second fixed terminal 6 may act on the arc. For example, when an electric current flows from left to right in the movable contact piece 7, the Lorentz force F5 directing inward in the left-right direction acts on the arc at the first contact position P1 due to the magnetic field generated by the electric current flowing through the first intermediate portion 22. In this case, a resultant force F1' of the Lorentz forces F1 and F5 acts on the arc, whereby the arc is drawn in the direction of the resultant force F1' of the Lorentz forces.

Similarly, when an electric current flows from left to right in the movable contact piece 7, the Lorentz force F6 directing inward in the left-right direction acts on the arc at the second contact position P2 due to the magnetic field generated by the electric current flowing through the second intermediate portion 32. In this case, a resultant force F2' of the Lorentz forces F2 and F6 acts on the arc, whereby the arc is drawn in the direction of the resultant force F2' of the Lorentz forces.

The relay 1*a* according to the present embodiment is configured with a wall portion 60 for extinguishing the arc drawn inward as described above. The wall portion 60 is disposed inside the first fixed contact 11 and the second fixed contact 12 in the left-right direction. The wall portion 60 includes a first wall portion 61 and a second wall portion 62. The first wall portion 61 is disposed between the first contact position P1 and the drive shaft 15 in the left-right direction. The first wall portion 61 extends in the front-back direction. The second wall portion 62 is disposed between the second contact position P2 and the drive shaft 15 in the left-right direction. The second wall portion 62 extends in the front-back direction.

The first wall portion 61 and the second wall portion 62 are formed of an arc extinguishing material that generates an arc extinguishing gas by the heat of the arc. The first wall portion 61 and the second wall portion 62 may be formed of a thermosetting resin such as an unsaturated polyester resin and a melamine resin, for example. Alternatively, the first wall portion 61 and the second wall portion 62 may be formed of a thermoplastic resin such as a polyolefin resin, a polyamide resin, and a polyacetal resin. Alternatively, the first wall portion 61 and the second wall portion 62 may be formed of other arc-extinguishing materials.

Figure 4:
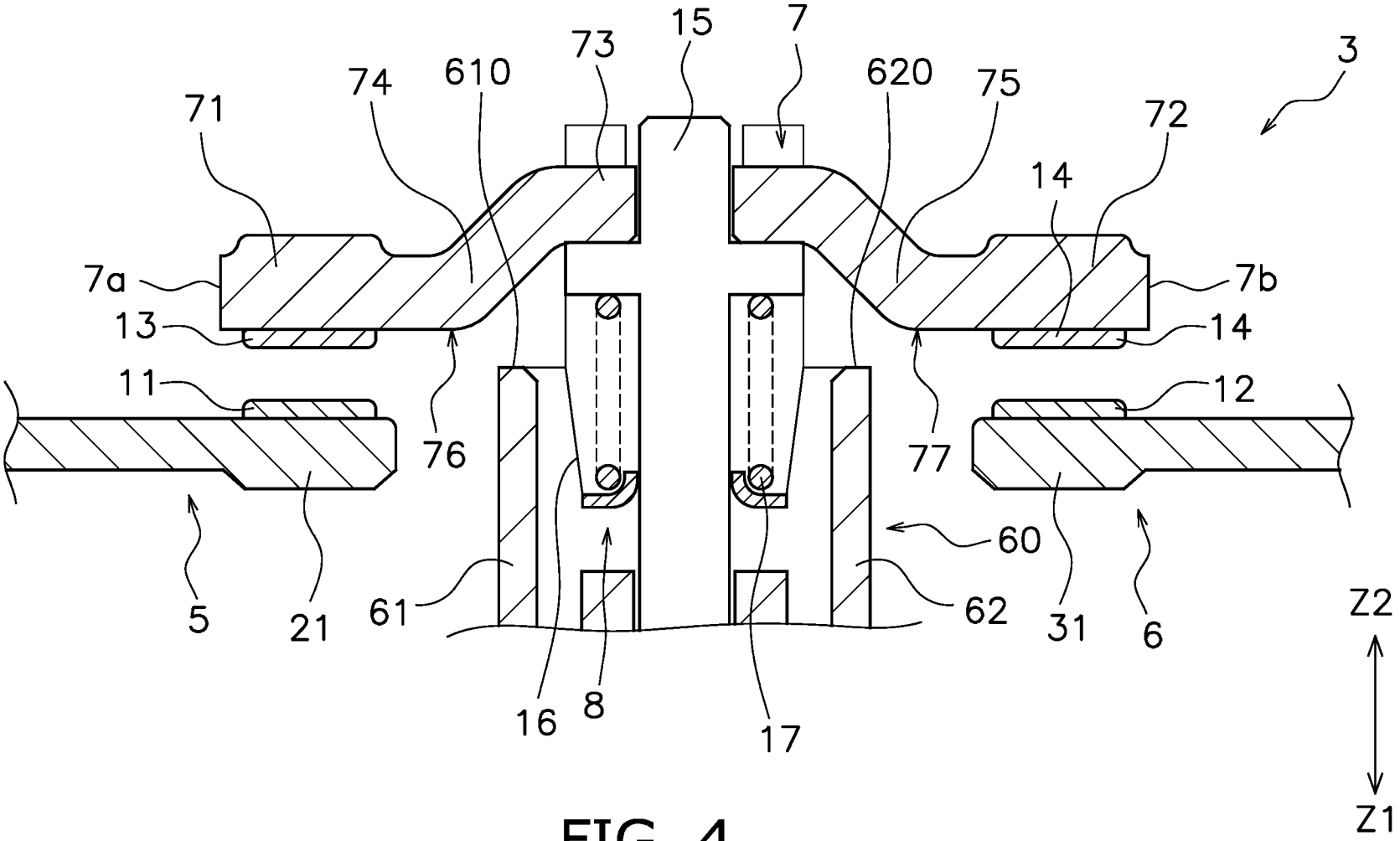
FIG. 4 is an enlarged side cross-sectional view of a contact device and a wall portion.
Figure 5:
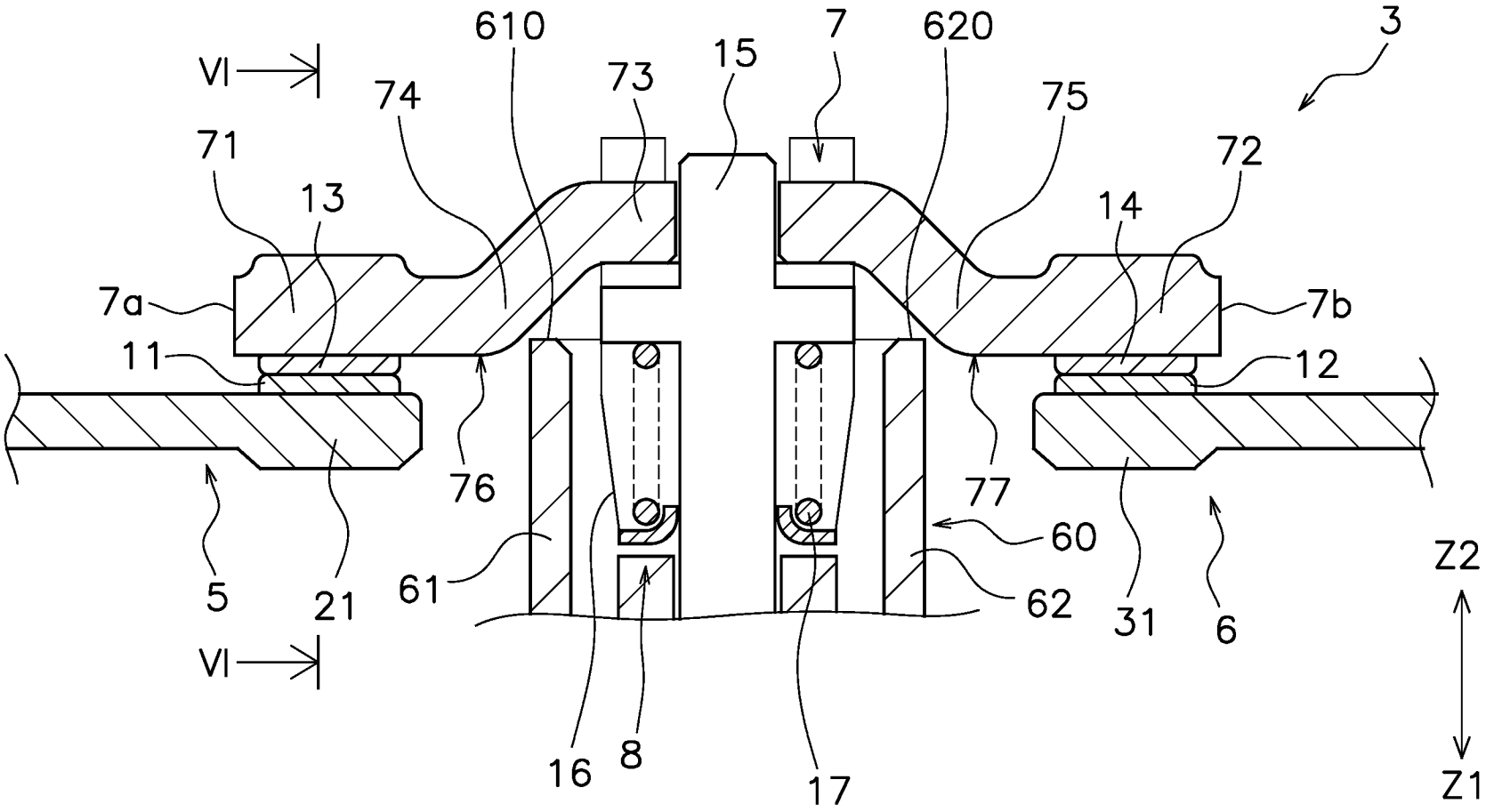
FIG. 5 is an enlarged side cross-sectional view of the contact device and the wall portion.

FIG. 4 and FIG. 5 are enlarged side cross-sectional views of the contact device 3 and the wall portion 60. FIG. 4 shows the position of the movable contact piece 7 in the open state. FIG. 5 shows the position of the movable contact piece 7 in the closed state. As illustrated in FIG. 4 and FIG. 5, the first wall portion 61 and the second wall portion 62 extend in the up-down direction. The first wall portion 61 faces the first fixed contact 11. The second wall portion 62 faces the second fixed contact 12. The first wall portion 61 is disposed at a position beyond the first fixed contact 11 toward the movable contact piece 7 in the moving direction of the movable contact piece. In other words, an upper end 610 of the first wall portion 61 is disposed above the first fixed contact 11. The first wall portion 61 is disposed from a position below the first fixed contact 11 to a position above the first fixed contact 11.

The second wall portion 62 faces the second fixed contact 12. The second wall portion 62 is disposed at a position beyond the second fixed contact 12 toward the movable contact piece 7 in the moving direction of the movable contact piece. In other words, an upper end 620 of the second wall portion 62 is disposed above the second fixed contact 12. The second wall portion 62 is disposed from a position below the second fixed contact 12 to a position above the second fixed contact 12.

Figure 6:
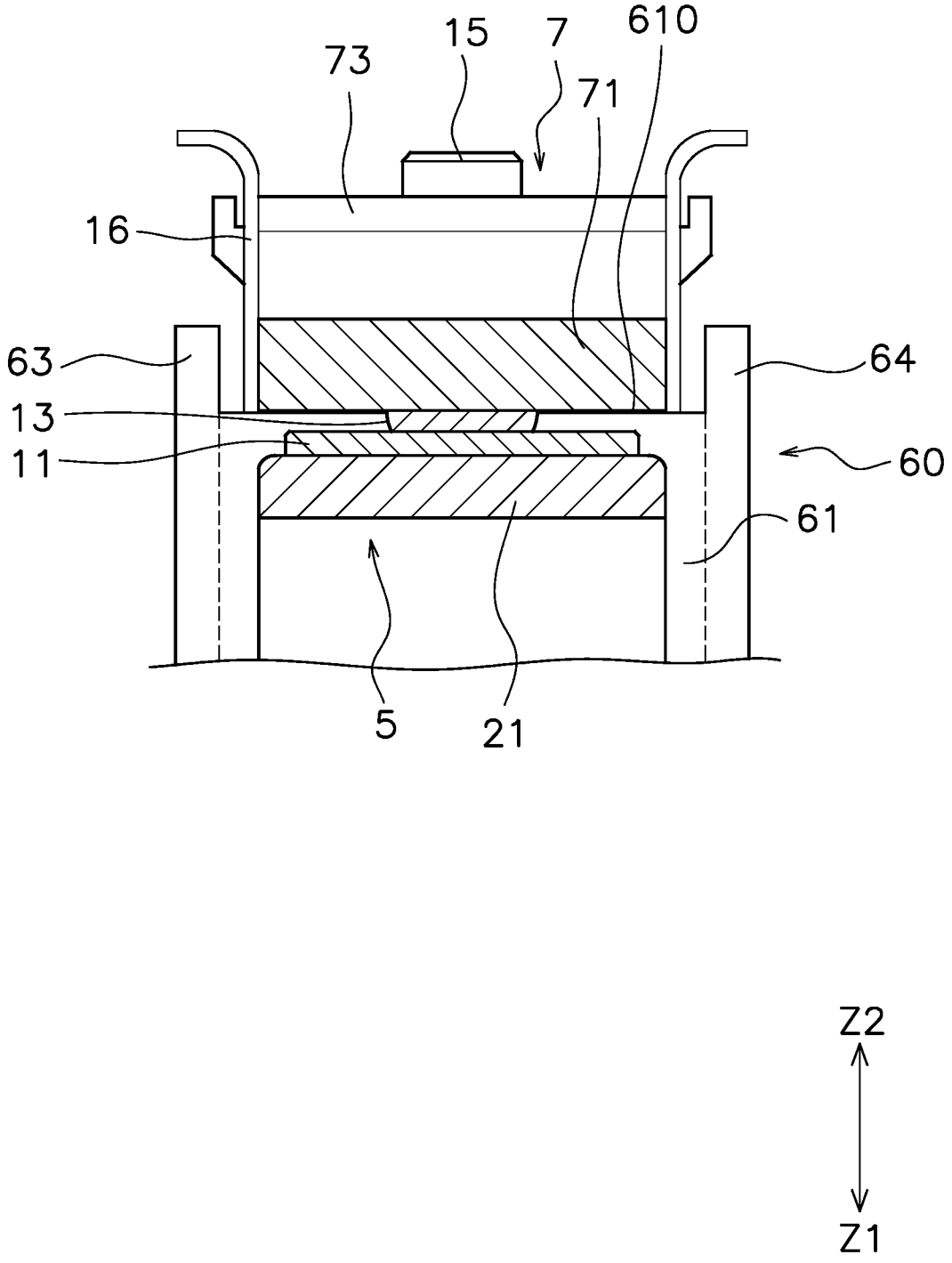
FIG. 6 is a cross-sectional view taken along line VI-VI of FIG. 5.

As illustrated in FIG. 5, the first wall portion 61 faces the first fixed contact 11 and the first movable contact 13 in the closed state. In the closed state, the upper end 610 of the first wall portion 61 is located above the lower end of the first movable contact 13. FIG. 6 is a cross-sectional view taken along line VI-VI of FIG. 5. As illustrated in FIG. 6, the first wall portion 61 overlaps with the first movable contact 13 and the first fixed contact 11 in the closed state when viewed from the longitudinal direction of the movable contact piece 7.

As illustrated in FIG. 4, the second wall portion 62 faces the second fixed contact 12 and the second movable contact 14 in the closed state. In the closed state, the upper end 620 of the second wall portion 62 is located above the lower end of the second movable contact 14. Although not illustrated, the second wall portion 62 overlaps with the second movable contact 14 and the second fixed contact 12 in the closed state when viewed from the longitudinal direction of the movable contact piece 7 as with the first wall portion 61.

As illustrated in FIG. 4 and FIG. 5, the movable contact piece 7 has a shape so that it avoids interference with the wall portion 60. The movable contact piece 7 has a shape recessed in a direction away from the wall portion 60. In other words, the movable contact piece 7 curves in a protruding shape in the upward direction. Specifically, the movable contact piece 7 includes a first contact support portion 71, a second contact support portion 72, an intermediate portion 73, a first curved portion 74, and a second curved portion 75.

The first contact support portion 71 supports the first movable contact 13. The first contact support portion 71 includes the first end portion 7*a* described above. The second contact support portion 72 supports the second movable contact 14. The second contact support portion 72 includes the second end portion 7*b* described above. The intermediate portion 73 is located at the center of the movable contact piece 7 in the left-right direction. The contact piece holding portion 8 is attached to the intermediate portion 73. A drive shaft 15 is attached to the intermediate portion 73. The intermediate portion 73 is located above the first contact support portion 71 and the second contact support portion 72.

The first curved portion 74 is located between the first contact support portion 71 and the intermediate portion 73. The first curved portion 74 has a shape curved in a direction away from the first wall portion 61. In other words, the first curved portion 74 has a shape curved upward from the first contact support portion 71. The first curved portion 74 is disposed to face the first wall portion 61.

The second curved portion 75 is located between the second contact support portion 72 and the intermediate portion 73. The second curved portion 75 has a shape curved in a direction away from the second wall portion 62. In other words, the second curved portion 75 has a shape curved upward from the second contact support portion 72. The second curved portion 75 is disposed to face the second wall portion 62.

As illustrated in FIG. 5, the upper end 610 of the first wall portion 61 is located above the bottom surface of the first contact support portion 71 in the closed state. The upper end 620 of the second wall portion 62 is located above the bottom surface of the second contact support portion 72 in the closed state. A connection point 76 between the first curved portion 74 and the first contact support portion 71 is located outward of the first wall portion 61. A connection point 77 between the second curved portion 75 and the second contact support portion 72 is located outward of the second wall portion 62. In the closed state, the connection point 76 between the first curved portion 74 and the first contact support portion 71 is located below the upper end 610 of the first wall portion 61. In the closed state, the connection point 77 between the second curved portion 75 and the second contact support portion 72 is located below the upper end 620 of the second wall portion 62.

As illustrated in FIG. 2, the wall portion 60 further includes a third wall portion 63 and a fourth wall portion 64. The third wall portion 63 and the fourth wall portion 64 are disposed apart from each other in the front-back direction. The contact piece holding portion 8 is disposed between the third wall portion 63 and the fourth wall portion 64. Specifically, the holder 16 is disposed between the third wall portion 63 and the fourth wall portion 64. The holder 16 is prevented from rotating by the third wall portion 63 and the fourth wall portion 64.

In the relay 1*a* according to the first embodiment described above, the first wall portion 61 and the second wall portion 62 are disposed at positions beyond the first fixed contact 11 and the second fixed contact 12 respectively toward the movable contact piece 7 in the moving direction of the movable contact piece. Therefore, when the arc is drawn inward of the first fixed contact 11 and the second fixed contact 12, the arc easily hits the first wall portion 61 and the second wall portion 62. As a result, the arc can be extinguished quickly.

Further, the movable contact piece 7 has a curved shape so as not to interfere with the first wall portion 61 and the second wall portion 62 in the closed state. Therefore, even if the first wall portion 61 and the second wall portion 62 are disposed as described above, interference between the movable contact piece 7, and the first wall portion 61 and the second wall portion 62 can be avoided.

The movable contact piece 7 includes the first curved portion 74 and the second curved portion 75. Due to this shape of the movable contact piece 7, interference with the first wall portion 61 and the second wall portion 62 can be avoided. Further, the starting point of the arc can be limited to the first curved portion 74 and the second curved portion 75. As a result, the arc drawn from the first curved portion 74 hits the first wall portion 61 more easily. Further, the arc drawn from the second curved portion 75 hits the second wall portion 62 more easily. Thereby, the arc can be extinguished more quickly.

In the closed state, the first wall portion 61 overlaps with the first movable contact 13 when viewed from the longitudinal direction of the movable contact piece 7. Further, in the closed state, the second wall portion 62 overlaps with the second movable contact 14 when viewed from the longitudinal direction of the movable contact piece 7. Therefore, the arc hits the first wall portion 61 and the second wall portion 62 more easily. Thereby, the arc can be extinguished more quickly.

Figure 7:
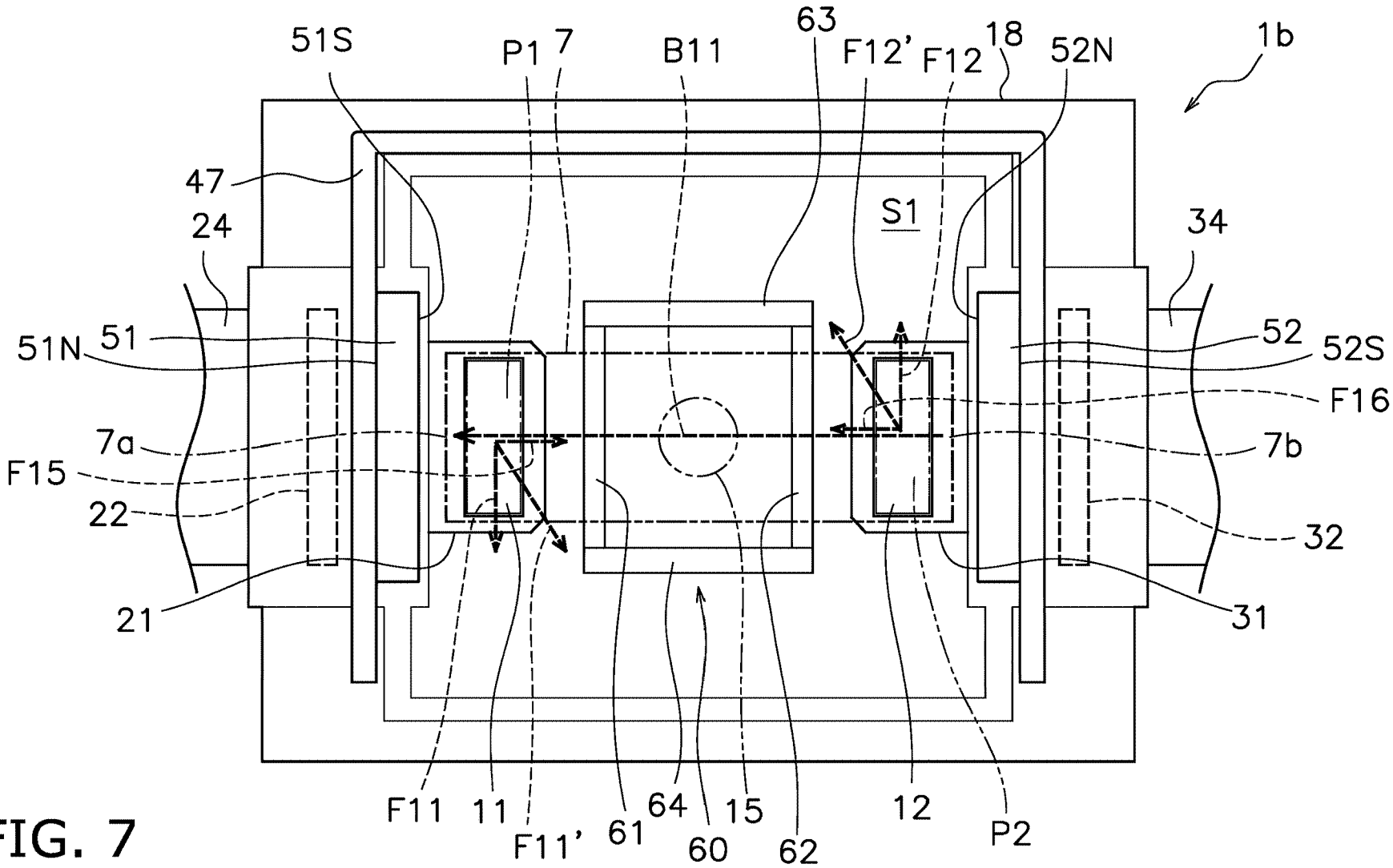
FIG. 7 is a plan view illustrating a configuration inside a contact case of a relay according to a second embodiment.

Although the relay 1*a* according to the first embodiment has been described as above, the arrangement or polarity of the first to third magnets 51-53 is not limited to that of the first embodiment and may be modified. For example, FIG. 7 is a plan view illustrating a configuration in the contact case 18 in a relay 1*b* according to a second embodiment.

In the relay 1*b* according to the second embodiment, the first magnet 51 and the second magnet 52 are disposed so that their different poles face each other. The S pole surface 51S of the first magnet 51 is disposed to face the movable contact piece 7, and the N pole surface 52N of the second magnet 52 is disposed to face the movable contact piece 7. In the relay 1*b* according to the second embodiment, the third magnet 53 of the first embodiment is omitted. Other configurations of the relay 1*b* according to the second embodiment are the same as those of the relay 1*a* according to the first embodiment.

In the relay 1*b* according to the second embodiment, a magnetic flux B11 toward the left is generated at the first contact position P1 and the second contact position P2. Therefore, when an electric current flows from left to right in the movable contact piece 7, the Lorentz force acts in the front-back direction as illustrated by an arrow F11 and an arrow F12.

Further, the Lorentz force due to the self-magnetic field of the first fixed terminal 5 and the second fixed terminal 6 may act on the arc. For example, when an electric current flows from left to right in the movable contact piece 7, the Lorentz force F15 directing inward in the left-right direction acts on the arc at the first contact position P1 due to the magnetic field generated by the electric current flowing through the first intermediate portion 22. In this case, the resultant force F11' of the Lorentz forces F11 and F15 acts on the arc, whereby the arc is drawn in the direction of the resultant force F11' of the Lorentz forces.

Similarly, when an electric current flows from left to right in the movable contact piece 7, the Lorentz force F16 directing inward in the left-right direction acts on the arc at the second contact position P2 due to the magnetic field generated by the current flowing through the second intermediate portion 32. In this case, the resultant force F12' of the Lorentz forces F12 and F16 acts on the arc, whereby the arc is drawn in the direction of the resultant force F12' of the Lorentz forces. Even in this case, the arc can be quickly extinguished by the first wall portion 61 and the second wall portion 62 in the relay 1*b* according to the second embodiment, similarly to the relay 1*a* according to the first embodiment.

Figure 8:
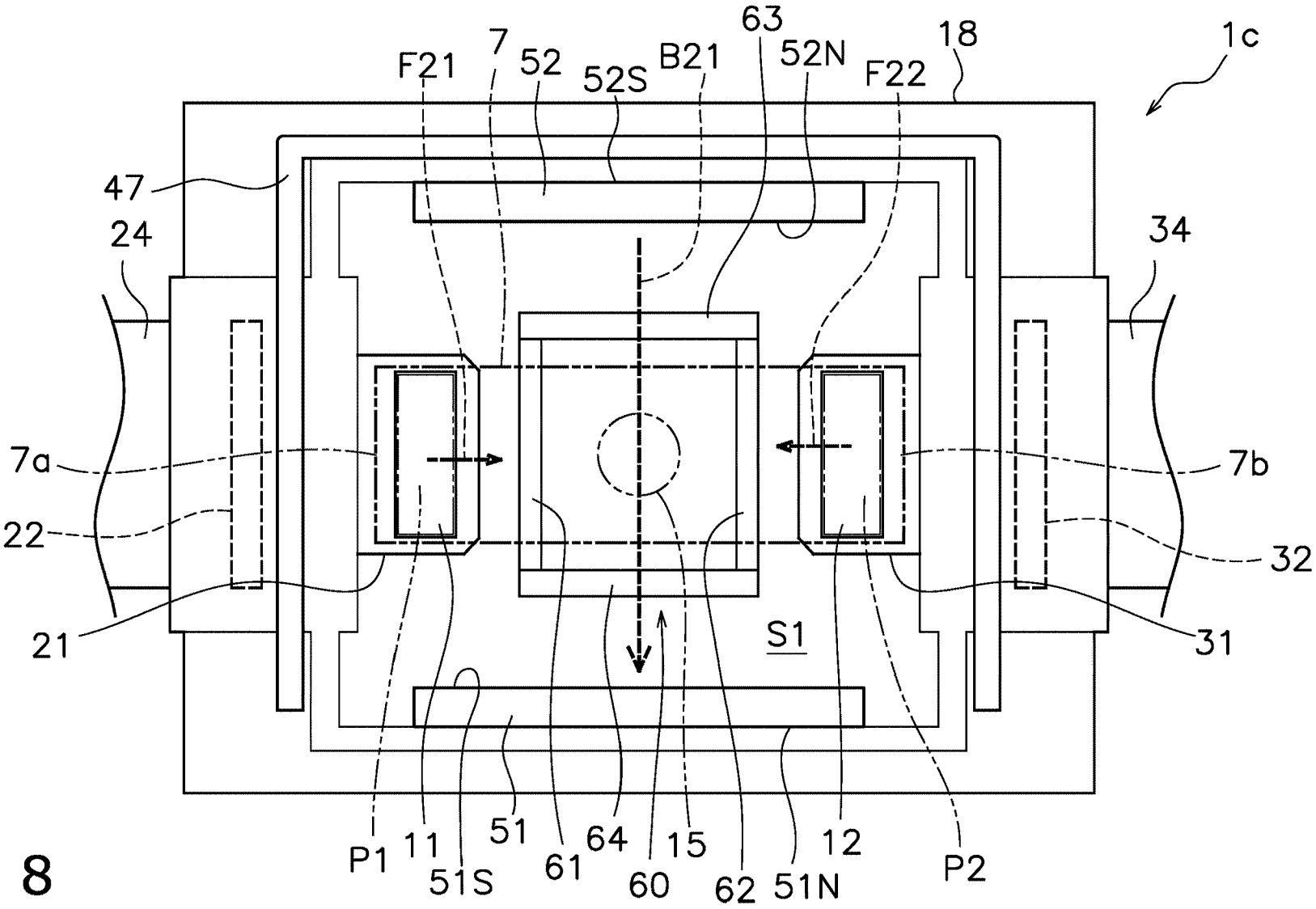
FIG. 8 is a plan view illustrating a configuration inside a contact case of a relay according to a third embodiment.

FIG. 8 is a plan view illustrating a configuration in the contact case 18 in a relay 1*c* according to a third embodiment. In the relay 1*c* according to the third embodiment, the first magnet 51 and the second magnet 52 are disposed apart from each other in the front-back direction. The first magnet 51 and the second magnet 52 are disposed so that their different poles face each other. Specifically, the S pole surface 51S of the first magnet 51 is disposed to face the movable contact piece 7, and the N pole surface 52N of the second magnet 52 is disposed to face the movable contact piece 7. Other configurations of the relay 1*c* according to the third embodiment are the same as those of the relay 1*a* according to the first embodiment.

In the relay 1*c* according to the third embodiment, a magnetic flux B21 along the front-back direction is generated at the first contact position P1 and the second contact position P2. Therefore, when an electric current flows from left to right in the movable contact piece 7, the Lorentz force acts inward in the left-right direction as illustrated by the arrows F21 and F22. Therefore, in the relay 1*c* according to the third embodiment, the arc is drawn inward even if the Lorentz force due to the self-magnetic field of the first fixed terminal 5 and the second fixed terminal 6 is not generated. Therefore, the arc is drawn inward even without the first intermediate portion 22 and the second intermediate portion 32. Even in this case, in the relay 1*c* according to the third embodiment, the arc is quickly extinguished by the first wall portion 61 and the second wall portion 62, similarly to the relay 1*a* according to the first embodiment.

Figure 9A:
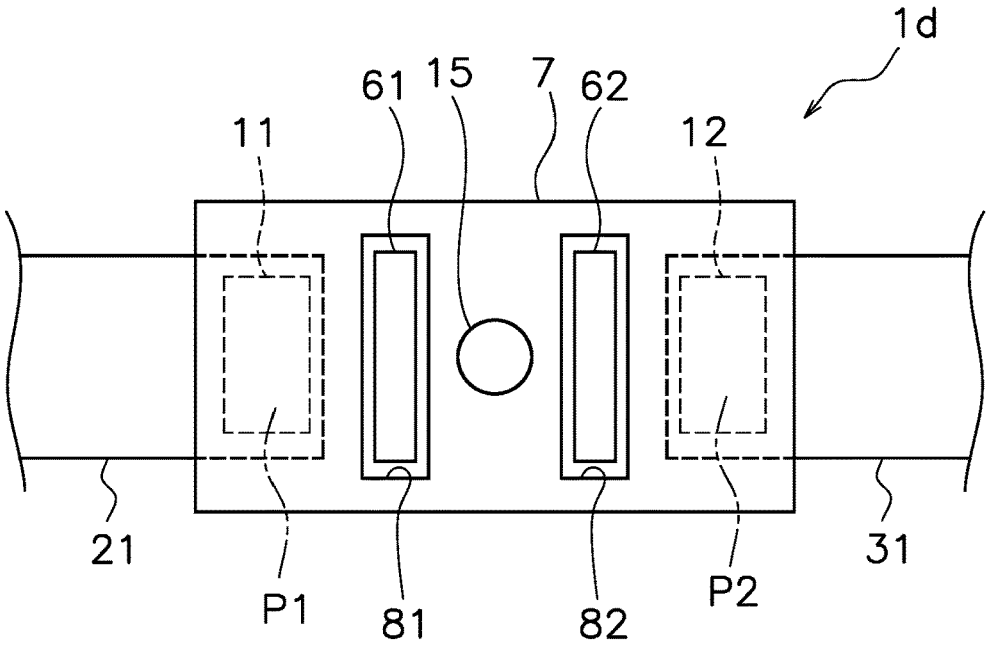
FIG. 9A shows a plan view and a side view illustrating a configuration inside a contact case of a relay according to a fourth embodiment.
Figure 9B:
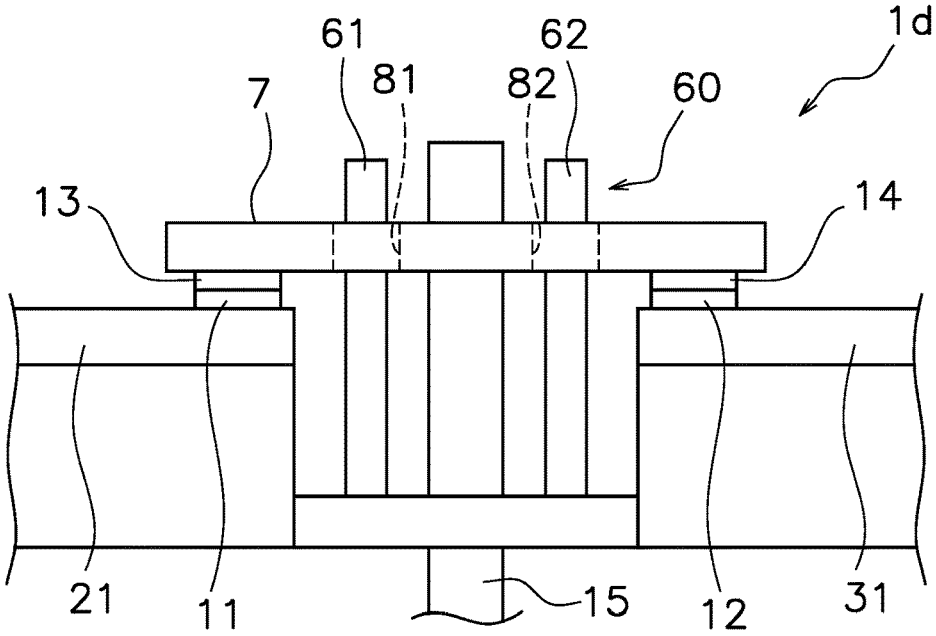
FIG. 9B shows a plan view and a side view illustrating a configuration inside a contact case of a relay according to a fourth embodiment.

Although the relays 1*a*-1*c* according to the first to third embodiments have been described above, the shape or arrangement of the movable contact piece 7 is not limited to those of the above embodiments and may be modified. For example, FIG. 9A is a plan view illustrating a configuration in the contact case 18 in a relay 1*d* according to a fourth embodiment. FIG. 9B is a side view illustrating a configuration of the relay 1*d* according to the fourth embodiment in the contact case 18.

As illustrated in FIG. 9A and FIG. 9B, the movable contact piece 7 includes a first hole 81 and a second hole 82. The first hole 81 and the second hole 82 penetrate the movable contact piece 7 in the up-down direction. The first hole 81 is disposed to face the first wall portion 61 in the up-down direction. The second hole 82 is disposed to face the second wall portion 62 in the up-down direction. Specifically, the first hole 81 is arranged above the first wall portion 61. The second hole 82 is arranged above the second wall portion 62. The first hole 81 has a size big enough for the first wall portion 61 to be inserted into. The second hole 82 has a size big enough for the second wall portion 62 to be inserted into.

In the relay 1*d* according to the fourth embodiment, the first wall portion 61 is arranged in the first hole 81 and the second wall portion 62 is arranged in the second hole 82 at least in the closed state. As a result, the interference between the first wall portion 61 and the second wall portion 62, and the movable contact piece 7 can be avoided. The first wall portion 61 may be arranged in the first hole 81 and the second wall portion 62 may be arranged in the second hole 82 not only in the closed state but also in the open state.

Figure 10A:
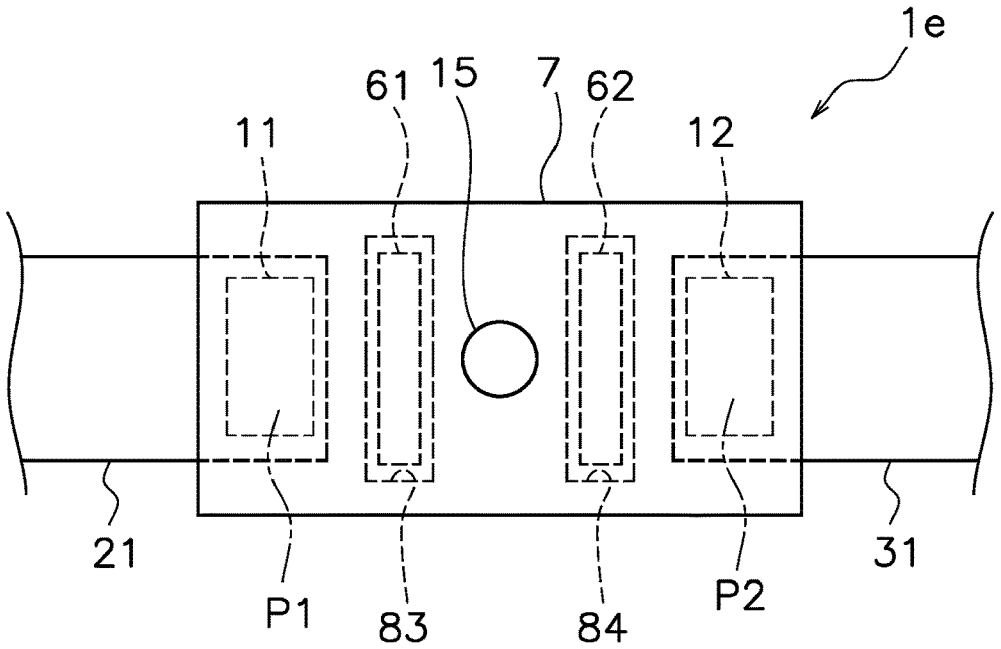
FIG. 10A shows a plan view and a side view illustrating a configuration inside a contact case of a relay according to a fifth embodiment.
Figure 10B:
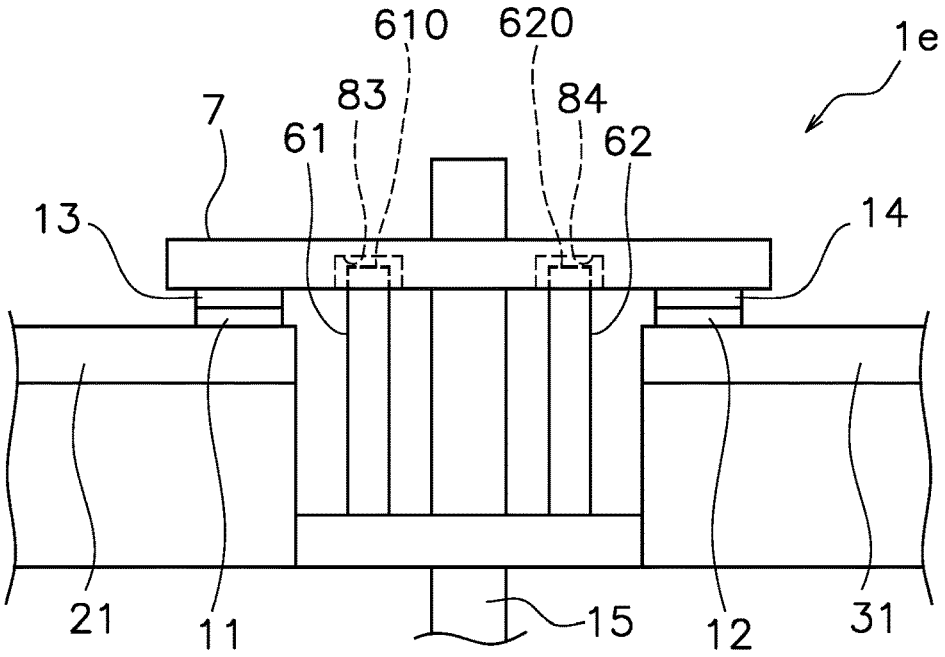
FIG. 10B shows a plan view and a side view illustrating a configuration inside a contact case of a relay according to a fifth embodiment.

FIG. 10A is a plan view illustrating a configuration in the contact case 18 in a relay 1*e* according to a fifth embodiment. FIG. 10B is a side view illustrating a configuration in the contact case 18 in the relay 1*e* according to the fifth embodiment.

As illustrated in FIG. 10A and FIG. 10B, the movable contact piece 7 includes a first recess 83 and a second recess 84. The first recess 83 and the second recess 84 have a shape recessed upward from the bottom surface of the movable contact piece 7. The first recess 83 is disposed to face the first wall portion 61 in the up-down direction. The second recess 84 is disposed to face the second wall portion 62 in the up-down direction. Specifically, the first recess 83 is arranged above the first wall portion 61. The second recess 84 is arranged above the second wall portion 62. The first recess 83 has a size big enough for the upper end 610 of the first wall portion 61 to be inserted into. The second recess 84 has a size big enough for the upper end 620 of the second wall portion 62 to be inserted into.

In the relay 1*e* according to the fifth embodiment, the first wall portion 61 is arranged in the first recess 83 and the second wall portion 62 is arranged in the second recess 84 at least in a closed state. As a result, interference between the first wall portion 61 and the second wall portion 62, and the movable contact piece 7 can be avoided. The first wall portion 61 may be arranged in the first recess 83 and the second wall portion 62 may be arranged in the second recess 84 not only in the closed state but also in the open state.

Figure 11:
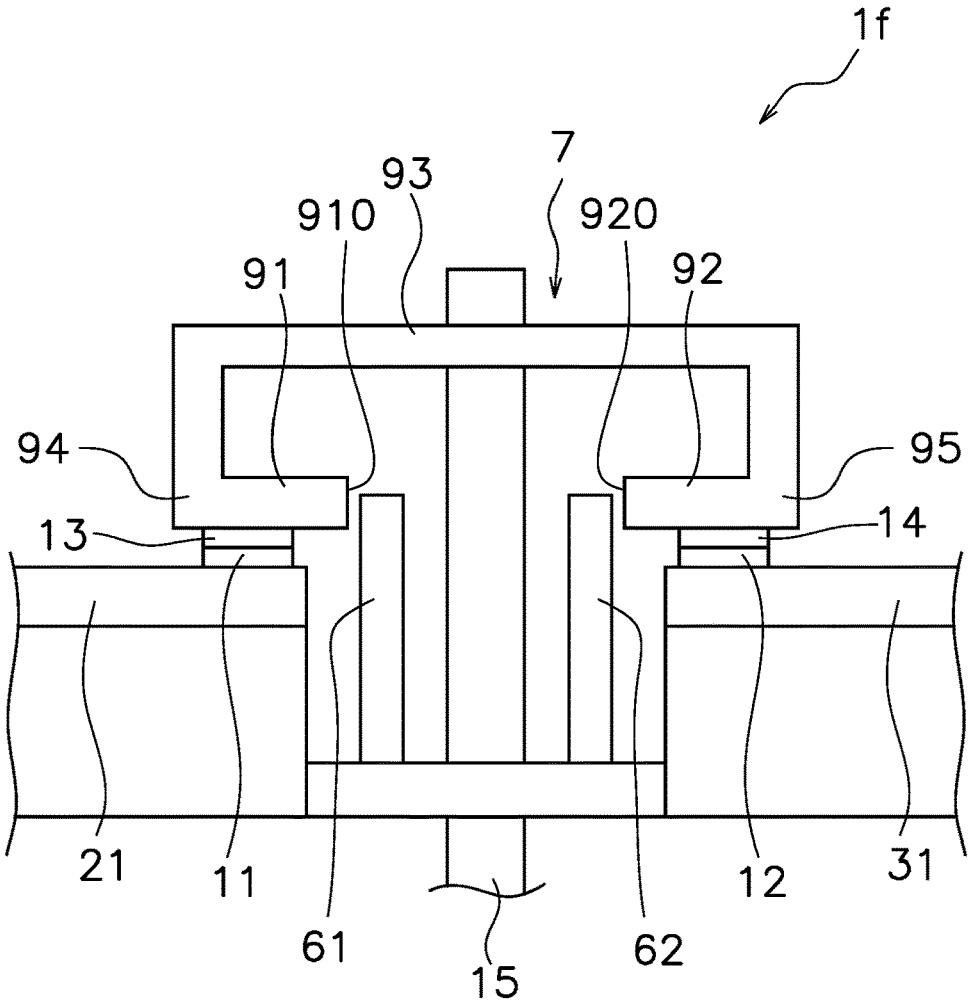
FIG. 11 is a side view illustrating a configuration inside a contact case of a relay according to a sixth embodiment.

FIG. 11 is a side view illustrating a configuration in the contact case 18 in a relay 1*f* according to a sixth embodiment. As illustrated in FIG. 11, the movable contact piece 7 includes a first contact support portion 91, a second contact support portion 92, an intermediate portion 93, a first bent portion 94, and a second bent portion 95. The first contact support portion 91 supports the first movable contact 13. The second contact support portion 92 supports the second movable contact 14. The first bent portion 94 has a shape that bends upward from the first contact support portion 91. The first bent portion 94 is located outward of the first contact support portion 91 in the left-right direction. The second bent portion 95 has a shape that bends upward from the second contact support portion 92. The second bent portion 95 is located outward of the second contact support portion 92 in the left-right direction. The intermediate portion 93 is located between the first bent portion 94 and the second bent portion 95. The intermediate portion 93 is located above the first contact support portion 91 and the second contact support portion 92.

In the relay 1*f* according to the sixth embodiment, an inner end portion 910 of the first contact support portion 91 and an inner end portion 920 of the second contact support portion 92 are disposed apart from each other. The first wall portion 61 and the second wall portion 62 are disposed to face a space between the inner end portion 910 of the first contact support portion 91 and the inner end portion 920 of the second contact support portion 92. At least in the closed state, the first wall portion 61 and the second wall portion 62 are disposed between the inner end portion 910 of the first contact support portion 91 and the inner end portion 920 of the second contact support portion 92. As a result, interference between the first wall portion 61 and the second wall portion 62, and the movable contact piece 7 can be avoided. In addition, the first wall portion 61 and the second wall portion 62 may be disposed between the inner end portion 910 of the first contact support portion 91 and the inner end portion 920 of the second contact support portion 92 not only in the closed state but also in the open state.

In the above embodiment, the drive device 4 pulls in the drive shaft 15 from the coil 41 side so that the movable contact piece 7 moves in the contact direction Z1. The drive device 4 pushes out the drive shaft 15 from the coil 41 side, the movable contact piece 7 moves in the separation direction Z2. However, the operating direction of the drive shaft 15 for opening and closing the contacts may be opposite to that of the above embodiment. In other words, the movable contact piece 7 may move in the separation direction Z2 by the drive device 4 pulling in the drive shaft 15 to the coil 41 side. The movable contact piece 7 may move in the contact direction Z1 by the drive device 4 pushing out the drive shaft 15 from the coil 41 side. In other words, the contact direction Z1 and the separation direction Z2 may be upside down from those in the above-described embodiment.

Figure 12:
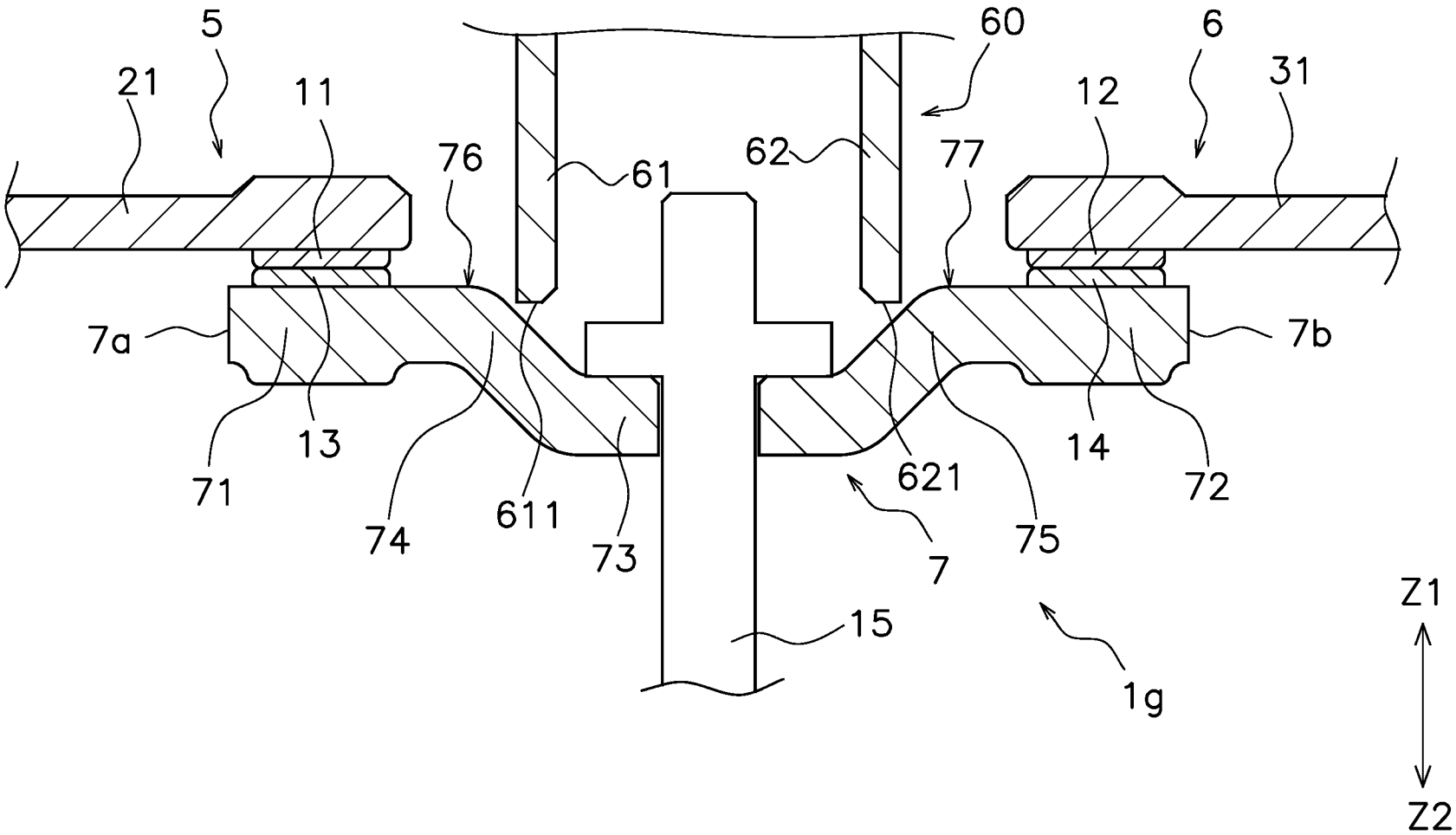
FIG. 12 is a side view illustrating a configuration inside a contact case of a relay according to a seventh embodiment.

For example, FIG. 12 is a side view illustrating a configuration in the contact case 18 in a relay 1*g* according to a seventh embodiment. As illustrated in FIG. 12, in the relay 1*g* according to the seventh embodiment, the movable contact piece 7 is disposed below the first fixed contact 11 and the second fixed contact 12. When the movable contact piece 7 moves upward, that is, in the contact direction Z1, the first movable contact 13 and the second movable contact 14 come into contact with the first fixed contact 11 and the second fixed contact 12. When the movable contact piece 7 moves downward, that is, in the separation direction Z2, the first movable contact 13 and the second movable contact 14 are separated from the first fixed contact 11 and the second fixed contact 12.

In the relay 1*g* according to the seventh embodiment, the first wall portion 61 and the second wall portion 62 are disposed as in the relay 1*a* according to the first embodiment. In the relay 1*g* according to the seventh embodiment, the lower end 611 of the first wall portion 61 and the lower end 621 of the second wall portion 62 face the movable contact piece 7. Further, the movable contact piece 7 has a curved shape so as to avoid interference with the first wall portion 61 and the second wall portion 62. The movable contact piece 7 may have the same shape as the movable contact piece 7 of the relays 1*d*-1*f* according to the fourth to sixth embodiments.

Although the embodiments of the present invention have been described above, the present invention is not limited to the above embodiments, and various modifications can be made without departing from the gist of the invention. For example, the configuration of the drive device 4 may be modified. The shape or arrangement of the coil 41, the spool 42, the iron core 43, the return spring 44, or the yoke 45 may be modified. The shape or arrangement of the case 2 may be modified.

The shape or arrangement of the first fixed terminal 5, the second fixed terminal 6, and the movable contact piece 7 may be modified. For example, the first external connection portion 24 and the second external connection portion 34 may protrude upward from the case 2. Alternatively, the first external connection portion 24 and the second external connection portion 34 may protrude from the case 2 in the front-back direction.

The first fixed contact 11 may be separate from or integrated with the first fixed terminal 5. The second fixed contact 12 may be separate from or integrated with the second fixed terminal 6. The first movable contact 13 may be separate from or integrated with the movable contact piece 7. The second movable contact 14 may be a separate from or integrated with the movable contact piece 7.

The shape or arrangement of the wall portion 60 may be modified. For example, the shape or arrangement of the first to fourth wall portions 61-64 may be modified. The third wall portion 63 and the fourth wall portion 64 may be omitted.

REFERENCE NUMERALS

4 Drive device
7 Movable contact piece
8 Contact piece holding portion
11 First fixed contact
12 Second fixed contact
13 First movable contact
14 Second movable contact
60 Wall portion
71 First contact support portion
73 Intermediate portion
74 First curved portion
81 First hole

The invention claimed is:

1. A relay comprising:

a movable contact piece including a first movable contact and a second movable contact disposed apart from each other in a longitudinal direction;

a first fixed terminal including a first fixed contact disposed to face the first movable contact;

a second fixed terminal including a second fixed contact disposed to face the second movable contact;

a contact piece holding portion configured to hold the movable contact piece;

a drive device configured to move the movable contact piece in a moving direction including a first direction in which the first movable contact comes into contact with the first fixed contact and the second movable contact comes into contact with the second fixed contact and a second direction in which the first movable contact is separated from the first fixed contact and the second movable contact is separated from the second fixed contact; and a wall portion disposed inside the first fixed contact and the second fixed contact in the longitudinal direction;

wherein at least a part of the wall portion is disposed between the first fixed contact and the contact piece holding portion, an end of the wall portion is disposed at a position beyond the first fixed contact and the second fixed contact toward the movable contact piece in the moving direction of the movable contact piece, the movable contact piece has a shape so as to avoid the wall portion in a contact state where the first movable contact is in contact with the first fixed contact and the second movable contact is in contact with the second fixed contact, and the wall portion overlaps with the contact piece holding portion in the contact state when viewed from the longitudinal direction.

2. The relay according to claim 1, wherein the wall portion is formed of an arc extinguishing material that generates an arc-extinguishing gas by heat of an arc.

3. The relay according to claim 1, wherein the movable contact piece has a shape recessed in a direction away from the wall portion.

4. The relay according to claim 1, wherein the movable contact piece includes a curved portion curved in a direction away from the wall portion.

5. The relay according to claim 4, wherein the curved portion is disposed to face the wall portion.

6. The relay according to claim 1, wherein the movable contact piece includes a hole disposed to face the wall portion.

7. The relay according to claim 1, wherein the movable contact piece includes a recess disposed to face the wall portion.

8. The relay according to claim 1, wherein the movable contact piece includes a first contact support portion configured to support the first movable contact, and a second contact support portion configured to support the second movable contact, and wherein an inner end of the first contact support portion and an inner end of the second contact support portion are disposed apart from each other in the longitudinal direction of the movable contact piece, and the wall portion is disposed to face a space between the inner end of the first contact support portion and the inner end of the second contact support portion.

9. The relay according to claim 1, wherein the wall portion overlaps with the first movable contact and the first fixed contact when viewed from the longitudinal direction of the movable contact piece in the contact state.

10. The relay according to claim 1, wherein the first fixed terminal includes a contact support portion configured to support the first fixed contact, and extending outward from the first fixed contact in the longitudinal direction, and an intermediate portion extending from the contact support portion in a direction parallel to the moving direction of the movable contact piece.

11. The relay according to claim 1, wherein the wall portion overlaps with the contact piece holding portion in a state where the first movable contact is separated from the first fixed contact and the second movable contact is separated from the second fixed contact when viewed from the longitudinal direction.

12. The relay according to claim 1, wherein the wall portion includes a first wall portion and a second wall portion, at least part of the first wall portion being disposed between the first fixed contact and the contact piece holding portion as the at least part of the wall portion, the second wall portion being disposed between the second fixed contact and the contact piece holding portion.

13. A relay comprising:

a movable contact piece including a first movable contact and a second movable contact disposed apart from each other in a longitudinal direction;

a first fixed terminal including a first fixed contact disposed to face the first movable contact;

a second fixed terminal including a second fixed contact disposed to face the second movable contact;

a contact piece holding portion configured to hold the movable contact piece;

a drive device configured to move the movable contact piece in a moving direction including a first direction in which the first movable contact comes into contact with the first fixed contact and the second movable contact comes into contact with the second fixed contact and a second direction in which the first movable contact is separated from the first fixed contact and the second movable contact is separated from the second fixed contact; and a wall portion disposed inside the first fixed contact and the second fixed contact in the longitudinal direction;

wherein an end of the wall portion is disposed at a position beyond the first fixed contact and the second fixed contact toward the movable contact piece in the moving direction of the movable contact piece, the movable contact piece has a shape so as to avoid the wall portion in a contact state where the first movable contact is in contact with the first fixed contact and the second movable contact is in contact with the second fixed contact, the wall portion overlaps with the contact piece holding portion in the contact state when viewed from the longitudinal direction, the contact piece holding portion includes a drive shaft configured to connect the movable contact piece and the drive device, and the wall portion overlaps with the drive shaft in the contact state when viewed from the longitudinal direction.

14. The relay according to claim 13, wherein the contact piece holding portion further includes a holder and a contact spring, the holder being connected to the movable contact piece, the contact spring being disposed between the drive shaft and the holder, and the wall portion overlaps with the holder and the contact spring in the contact state when viewed from the longitudinal direction.

* * * * *